US007066412B2

(12) United States Patent
Conley et al.

(10) Patent No.: US 7,066,412 B2
(45) Date of Patent: Jun. 27, 2006

(54) APPARATUS, METHODS, AND COMPOSITIONS FOR ADDING FRAGRANCE TO LAUNDRY

(75) Inventors: Samuel G. Conley, Gurnee, IL (US); Claudio L. K. Lins, Racine, WI (US); Allan J. Morris, Racine, WI (US); William E. Simpson, New Berlin, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 473 days.

(21) Appl. No.: 10/156,703

(22) Filed: May 28, 2002

(65) Prior Publication Data

US 2003/0224965 A1 Dec. 4, 2003

(51) Int. Cl.
*B05B 5/00* (2006.01)

(52) U.S. Cl. ..... 239/690; 239/337; 34/499; 34/497; 34/498; 34/523; 34/524; 34/549; 34/60; 34/72; 34/390; 34/389; 34/380; 68/200; 422/292; 422/305

(58) Field of Classification Search ..... 34/499, 34/497, 498, 523, 524, 549, 60, 72, 390, 34/389, 380; 239/690, 337; 68/200; 422/292, 422/305

See application file for complete search history.

(56) References Cited

U.S. PATENT DOCUMENTS

| | | | | |
|---|---|---|---|---|
| 2,807,893 | A | | 10/1957 | Morey |
| 2,851,791 | A | | 9/1958 | Olthuis |
| 2,873,539 | A | | 2/1959 | Morey |
| 3,180,037 | A | | 4/1965 | Kenreich et al. |
| 3,239,947 | A | | 3/1966 | Kenreich et al. |
| 3,435,537 | A | | 4/1969 | Rumsey, Jr. et al. |
| 3,650,816 | A | * | 3/1972 | Rudy et al. ..... 427/11 |
| 3,701,202 | A | | 10/1972 | Compa et al. |
| 3,872,604 | A | | 3/1975 | Keller |
| 3,963,629 | A | | 6/1976 | McLaughlin |
| 4,041,205 | A | | 8/1977 | Compa et al. |
| 4,121,009 | A | | 10/1978 | Chakrabarti |
| 4,207,683 | A | | 6/1980 | Horton |
| 4,236,320 | A | | 12/1980 | Schwadike et al. |
| 4,252,656 | A | | 2/1981 | Liebowitz et al. |
| 4,567,675 | A | | 2/1986 | Rennie |
| 4,749,596 | A | | 6/1988 | Evans et al. |
| 4,891,890 | A | | 1/1990 | Church |
| 4,909,179 | A | | 3/1990 | McBride |
| 5,072,526 | A | * | 12/1991 | Hirota et al. ..... 34/60 |
| 5,196,171 | A | | 3/1993 | Peltier |
| 5,234,610 | A | | 8/1993 | Gardlik et al. |
| 5,276,979 | A | | 1/1994 | Gordon, Sr. |
| 5,302,359 | A | * | 4/1994 | Nowatzki ..... 422/306 |

(Continued)

FOREIGN PATENT DOCUMENTS

CA 2116761 A 9/1995

(Continued)

*Primary Examiner*—Monique T. Cole
(74) *Attorney, Agent, or Firm*—Foley & Lardner LLP

(57) ABSTRACT

The invention provides an apparatus, methods, and compositions for dispensing a fragrance onto laundry in a dryer without substantial loss of that fragrance during the drying process. The apparatus includes an electrostatic vapor generator capable of dispensing a fragrance composition into a dryer. The invention also provides electrostatically dispensable fragrance compositions containing glycols, vegetable oils, and perfumes. The invention further provides a kit and method for enhancing residual fragrance on laundry by adding a fabric conditioning composition and a fragrance composition in separate steps during the laundering process. The invention includes embodiments wherein the dispensation of the fragrance compositions is computer controlled.

35 Claims, 2 Drawing Sheets

U.S. PATENT DOCUMENTS

| | | | | |
|---|---|---|---|---|
| 5,382,410 | A | 1/1995 | Peltier | |
| 5,438,773 | A | 8/1995 | Chaffee | |
| 5,447,644 | A | 9/1995 | Guenin et al. | |
| 5,503,335 | A | 4/1996 | Green et al. | |
| 5,591,395 | A | 1/1997 | Schroeder et al. | |
| 5,675,911 | A | 10/1997 | Moser | |
| 5,749,163 | A | 5/1998 | Staub et al. | |
| 5,810,265 | A * | 9/1998 | Cornelius et al. | 239/690 |
| 5,861,370 | A | 1/1999 | Trinh et al. | |
| 5,930,909 | A | 8/1999 | McNally | |
| 5,980,583 | A * | 11/1999 | Staub et al. | 8/149.2 |
| 6,022,845 | A | 2/2000 | Avila-Garcia et al. | |
| 6,083,899 | A | 7/2000 | Baker et al. | |
| 6,156,710 | A | 12/2000 | Sivik et al. | |
| 6,218,354 | B1 | 4/2001 | Demeyere et al. | |
| 6,220,267 | B1 * | 4/2001 | Joshi | 137/9 |
| 6,315,800 | B1 | 11/2001 | Gomes et al. | |
| 6,316,397 | B1 | 11/2001 | Sivik | |
| 6,398,127 | B1 * | 6/2002 | Wingo | 239/55 |
| 6,729,552 | B1 * | 5/2004 | McEwen et al. | 239/49 |
| 2002/0155026 | A1 * | 10/2002 | Lins | 422/4 |

FOREIGN PATENT DOCUMENTS

| | | | |
|---|---|---|---|
| EP | 0676497 | A | 10/1995 |
| EP | 1122352 | A | 8/2001 |
| WO | WO 9955815 | A | 11/1999 |
| WO | WO 0038512 | A | 7/2000 |
| WO | WO 0118145 | A | 3/2001 |
| WO | WO 01 90294 | A | 11/2001 |
| WO | WO 0185888 | A | 11/2001 |
| WO | WO 03074776 | A | 9/2003 |

* cited by examiner

APPARATUS, METHODS, AND COMPOSITIONS FOR ADDING FRAGRANCE TO LAUNDRY

FIELD OF THE INVENTION

This invention provides an apparatus, methods, and compositions useful for dispensing a fragrance composition onto laundry in a dryer. More specifically, the invention is directed to an apparatus, methods, and compositions for enhancing the residual fragrance on laundry after completion of a drying cycle in a clothes dryer.

BACKGROUND OF THE INVENTION

The desirability of adding a fragrance to laundry during the cleaning process has been recognized for decades. A vast array of scented fabric conditioners are available on the market today. These products combine perfumes with softening and conditioning agents to produce laundry that is soft, fresh smelling, static-free, crease-resistant, and easily ironed. In one approach, the conditioners are added during the wash cycle in a washing machine. However, this approach may be wasteful, because much of the perfumes on conditioners in the conditioning compositions do not adhere to the clothes in a washer and are washed away with the waste water. To avoid this waste, many consumers now add fabric conditioners during the drying process in a dryer. As discussed below, this approach has not been entirely satisfactory in imparting a lasting fragrance to freshly laundered articles.

Various methods for adding a fragrance to laundry in a dryer are well known. One of the most common methods employs dryer sheets which are impregnated with conditioning agents and allowed to tumble with the clothes in a dryer. During the drying process, fragrance is imparted to the clothes that come into contact with these dryer sheets. The dryer sheets are typically made of a spongy material and the conditioning agents are chosen such that they melt or flow at conventional dryer operating temperatures. Unfortunately, these dryer sheets suffer from several drawbacks. First, because the conditioning agents are applied by contact between articles of laundry and the sheets, application can be splotchy and uneven. In addition, in order to assure that all articles of laundry come into contact with the sheet, it is necessary for the dryer sheets to be put in the laundry early on in the drying cycle. This can be disadvantageous because any fragrances in the conditioning compositions are likely to volatilize during prolonged exposure to the heat of the drying cycle, leaving little residual fragrance at the end of the drying process. This problem is worsened in industrial dryers, such as those used by the hotel industry, which operate at much higher temperatures than do conventional home dryers. In fact, many industrial dryers work at temperatures hot enough to melt dryer sheets. Finally, the conditioning agents that can be used with dryer sheets are limited because they must be selected from compounds that melt or flow in a fairly specific temperature range. The compositions that meet these criteria are not optimally suited for use as softeners and conditioners.

In other laundry softening or conditioning methods, liquid or powder conditioners are housed in porous containers which are either allowed to tumble freely with the laundry in a dryer or which are attached to the drum of the dryer such that they spin with the laundry. These liquid or powder conditioners are then dispensed through the porous walls of the container during the drying process. As with dryer sheets, these porous containers apply conditioning agents by making direct contact with articles of laundry, which requires prolonged exposure to the laundry during the drying cycle and which may lead to an uneven application of the conditioning agents.

In another method, a fabric softener or conditioner is held in a container within a dryer and hot air is circulated over the container such that the fabric softener or conditioner vaporizes and is carried by the air stream over the laundry. This requires that the softener or conditioner be present during the hottest part of the drying cycle, resulting in the volatilization and loss of volatile fragrant components within the conditioning compositions.

Finally, it is known to spray or sprinkle liquid softeners or conditioners onto either the damp clothes as they enter the dryer, or onto the drum itself before the clothes are placed in the dryer such that the softener or conditioner permeates the laundry as it dries. Unfortunately, the spray nozzles used to apply conditioning compositions frequently dispense the liquids in droplets, rather than a fine mist or vapor which makes it difficult to precisely control the amount and distribution of the liquids as they are applied to laundry.

None of these methods has been entirely successful at imparting a lasting residual fragrance to articles of laundry. Thus, a need exists for a system that is able to impart a fragrance to laundry in a dryer without substantial loss of the fragrance before the completion of the drying process. Such a system would be of particular value to the hotel industry, where fresh-smelling robes, towels, and linens would enhance the comfort of guests and potentially create more repeat customers.

SUMMARY OF THE INVENTION

This invention provides an apparatus, methods, and compositions for dispensing a fragrance composition into a dryer without substantial loss of residual fragrance during the drying process.

One aspect of the invention provides an apparatus and systems for adding fragrance to laundry in a dryer which includes an electrostatic vapor generator for dispensing a fragrance composition into a dryer. One embodiment of the invention further includes a temperature or humidity sensor that detects the onset of a cool-down cycle in a dryer and triggers the dispensation of the fragrance composition into the dryer during the cool-down cycle. The triggering and duration of the dispensation may be automated using an appropriate processing device.

Another aspect of the invention provides fragrance compositions suited for electrostatic dispensation. Such compositions are characterized by a conductivity of between about 0.1 and 1.0 microsiemens per centimeter and a viscosity between 0.1 and 50 centipoise at 20° C. The compositions may be made from mixtures of various glycols, vegetable oils, and fragrances. In one embodiment, the composition comprises between about 1 and 10 weight percent glycol, between about 10 and 80 weight percent vegetable oil, and between about 10 and 80 weight percent of at least one fragrance.

Yet another aspect of the invention provides a kit for adding a fragrance to laundry comprising separate conditioning and fragrance compositions such that the user may add the conditioning composition prior to adding the fragrance composition. This aspect of the invention includes an embodiment where the conditioning composition is adapted to be added to the laundry in a washer while the fragrance composition is adapted to be added to the laundry after it has been transferred to the dryer. Alternatively, the kit may provide a conditioning composition that is added at the beginning of the drying cycle and a fragrance that is added at a later time during the drying process. The fragrance composition may be particularly suited for dispensation during the cool-down process in the dryer.

A final aspect of the invention provides a method for adding a fragrance to laundry. The method includes the step of adding a conditioning composition to laundry prior to adding a fragrance composition to the laundry. This aspect of the invention contemplates methods wherein the conditioning composition is added to the laundry during the washing process in a washer or during an early stage of the drying process in a dryer, and the fragrance composition is added to the laundry during the drying process in a dryer. In one embodiment, the fragrance composition is added during the cool-down cycle of the drying process. The triggering and duration of the dispensation of the fragrance composition may be automated using an appropriate processing device.

DETAILED DESCRIPTION OF THE INVENTION

Figure 1:
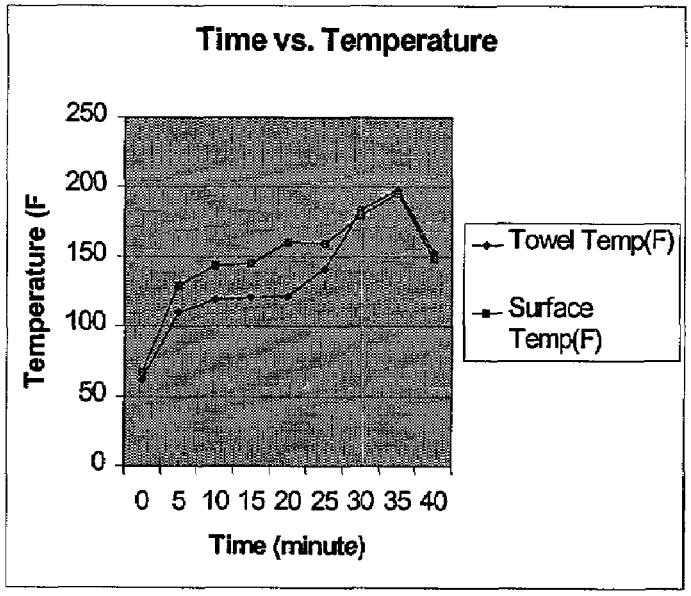
FIG. 1 shows the temperature profile of cotton towels in an industrial dryer as a function of time. The surface temperature is the temperature of the surface of the towels. The cool down cycle begins at minute 35.

This invention provides an apparatus, systems, methods, and compositions for dispensing a fragrance composition into a dryer without substantial loss of residual fragrance during the drying process. More particularly, this invention overcomes the disadvantages of prior systems by providing an improved apparatus for applying fragrances to laundry in a dryer, reducing the exposure of volatile fragrances to high dryer temperatures, and separating the addition of conditioning agents from the addition of fragrances during the laundering process.

For the purposes of this invention, conditioning compositions include any compositions which impart softness or crease-resistance, reduce static, or make laundry easier to iron. These compositions may include conditioning, anti-static, and softening agents, as well as perfumes and fragrances. The compositions are typically aqueous compositions and may include additional elements such as brighteners, bleaches, and dyes. Examples of softening agents and/or anti-static agents typically found in fabric softeners are well known in the art and include, but are not limited to, cationic and nonionic softeners, such as quaternary ammonium salts, including di-tallow quaternary ammonium salts, imidazolinium salts, esters of quaternary ammonium salts, amidoamines, carboxylic salts of tertiary alkylamines, fatty acid polyglycol esters, fatty acid alkanol amides, organic phosphoric acid esters, tertiary phosphine oxides, tertiary amine oxides, alkylated party ethoxylated polyamines, anionic soaps, sulfates, sulfonates, and the like. Specific examples of softening and/or anti-static agents include methyl bis(tallow amidoethyl)-2-hydroxyethyl ammonium methyl sulfate, ditallow dimethyl quaternary ammonium chloride, methyl bis(tallow amidoethyl)-2-tallow imadazolinium ammonium methyl sulfate, and methyl bis(ethyl tallowate)-2-hydroxyethyl ammonium methyl sulfate. Other examples of anti-static agents include polyhydric alcohols, amines, amides, polyoxy ethylene derivatives, amine soaps, amine salts of alkyl sulfates, alkyl phosphates, and the like.

Examples of suitable fabric softening agents, are provided in U.S. Pat. No. 5,234,610, which is herein incorporated by reference.

For the purposes of this invention dryers include any type of conventional laundry dryer. Such dryers are well known in the art. Examples of suitable dryers are described in U.S. Pat. Nos. 2,807,893 and 5,749,163, which are herein incorporated by reference. Dryers that can be used in conjunction with the present invention include conventional automatic clothes dryers. The dryers may be gas, electric, or steam powered and may be of the type used in homes or of the type used in industries, such as those used by the hotel industry. As will become clear in the following discussion, the present invention is particularly useful in industrial dryers which operate at temperature of up to, or greater than, 180° F., and sometimes at temperatures of up to 200° F. This is much hotter than the operating temperatures of home dryers which are typically run at temperatures below about 150° F. These higher temperatures exacerbate the problem of fragrance volatilization and loss during drying because most fragrances have flash points much lower than 200° F.

One aspect of the invention provides an apparatus for adding fragrance to laundry in a dryer comprising a dryer having an electrostatic vapor generator mounted within a dryer. For the purposes of this disclosure an electrostatic vapor generator is "mounted within a dryer" if it is connected or secured to or disposed within the dryer such that it is capable of dispensing a fragrance composition onto laundry within the dryer during the drying process. Suitable electrostatic vapor generators include any vapor generator that is capable of generating a vapor from a liquid by imparting an electrostatic charge to the liquid. Such electrostatic vapor generators are well known. Examples of suitable electrostatic vapor generators can be found in U.S. Pat. Nos. 5,196,171 and 5,382,410, issued to Peltier, which are hereby incorporated by reference. This apparatus represents an improvement over prior art methods of spraying a fragrance composition, such as a fabric softener, onto laundry in a dryer, because it allows for the production of a more uniform mist or vapor and because it allows for a more precise and adjustable control over the quantity and distribution of the composition onto the laundry. By imparting a negative charge to the fragrance composition the electrostatic vapor generator emits micro-aerosol particles that are electrostatically self-repelling. This results in a uniform mist of very fine "droplets" having an average diameter of less than about 10 microns and preferably less than about 5 microns. This is much smaller than the average diameter of the droplets produced by other aerosol systems which typically ranges from at least 15 microns and up to 30 or more microns. Small droplet size results in a more uniform distribution of the fragrance composition onto the laundry.

Typically, the electrostatic vapor generator will be integrated with a fragrance composition reservoir. For the purposes of this disclosure, a reservoir is "integrated with" an electrostatic vapor generator if it is connected to the electrostatic vapor generator in such a way that a fragrance composition can pass from the reservoir into the electrostatic vapor generator. The connection may be by any conventional means, such as tubing, pipes, and inlet and outlet ports. The reservoir will preferably contain a fragrance composition comprising a glycol, a vegetable oil, and a fragrance. Such compositions are described in more detail below.

In one embodiment of the invention, the apparatus further includes a temperature sensor or a humidity sensor mounted within the dryer that detects the onset of the cool-down cycle in a dryer and triggers the dispensation of the fragrance composition from the electrostatic vapor generator. In another embodiment, the apparatus includes a timing device capable of triggering the dispensation of the fragrance composition at a preset time, which may correspond to a time after the onset of the cool-down cycle. These embodiments ensure that the volatile fragrant components in the fragrance compositions are exposed to the heat of the dryer for only a limited time, resulting in less fragrance loss through evaporation during the drying process. The sensors may trigger a manual dispensation by alerting (e.g. by setting off a buzzer) the user that the cool-down process has begun so that the user may start the electrostatic vapor generator manually. Alternatively, the sensors may automatically start the electrostatic vapor generator once a preset time, or temperature or humidity level has been reached inside the dryer, or following a timing delay after the preset temperature or humidity level has been reached. Similarly, the sensors may automatically stop the electrostatic vapor generator once a second preset time, or temperature or humidity level has been reached. Suitable temperature and humidity sensors are well known. One example of a suitable temperature and humidity detector is the MC-HTD humidity and temperature manufactured by Panametrics.

Figure 2:
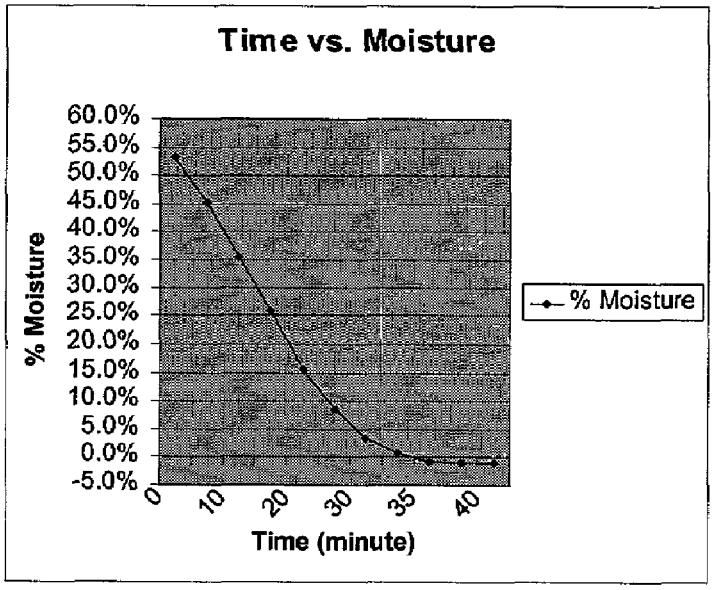
FIG. 2 shows the humidity profile for cotton towels in an industrial dryer as a function of time.

The dispensation initiating temperature or humidity level should reflect the onset of the cooling process. At the onset of the cooling process, the residual humidity level in the laundry will typically be less than about 5% and may be less than about 4%, or even less than about 3%. In various embodiments the dispensation takes place once the residual humidity level in the laundry is between about 3.6 and 0.6%. At this level of humidity the laundry will feel dry to the touch. Earlier dispensation would mean adding the fragrance composition prior to or during the hottest part of the drying process which would lead to flashing off of the fragrance. This is illustrated in FIGS. 1 and 2 which show the temperature and humidity profiles for laundry in a typical industrial dryer, wherein the temperature of the laundry increases until the onset of the cool down cycle. In one embodiment, the apparatus senses both temperature and humidity. The dispensation of the fragrance composition should begin at a temperature less than the maximum operating temperature of the dryer. A good temperature at which to trigger dispensation is 200° F. or less. In various embodiments dispensation will be triggered at temperatures between about 180° F. and about 120° F. This includes embodiments wherein the dispensation is triggered at temperatures between about 150 and 120° F.

Figure 3:
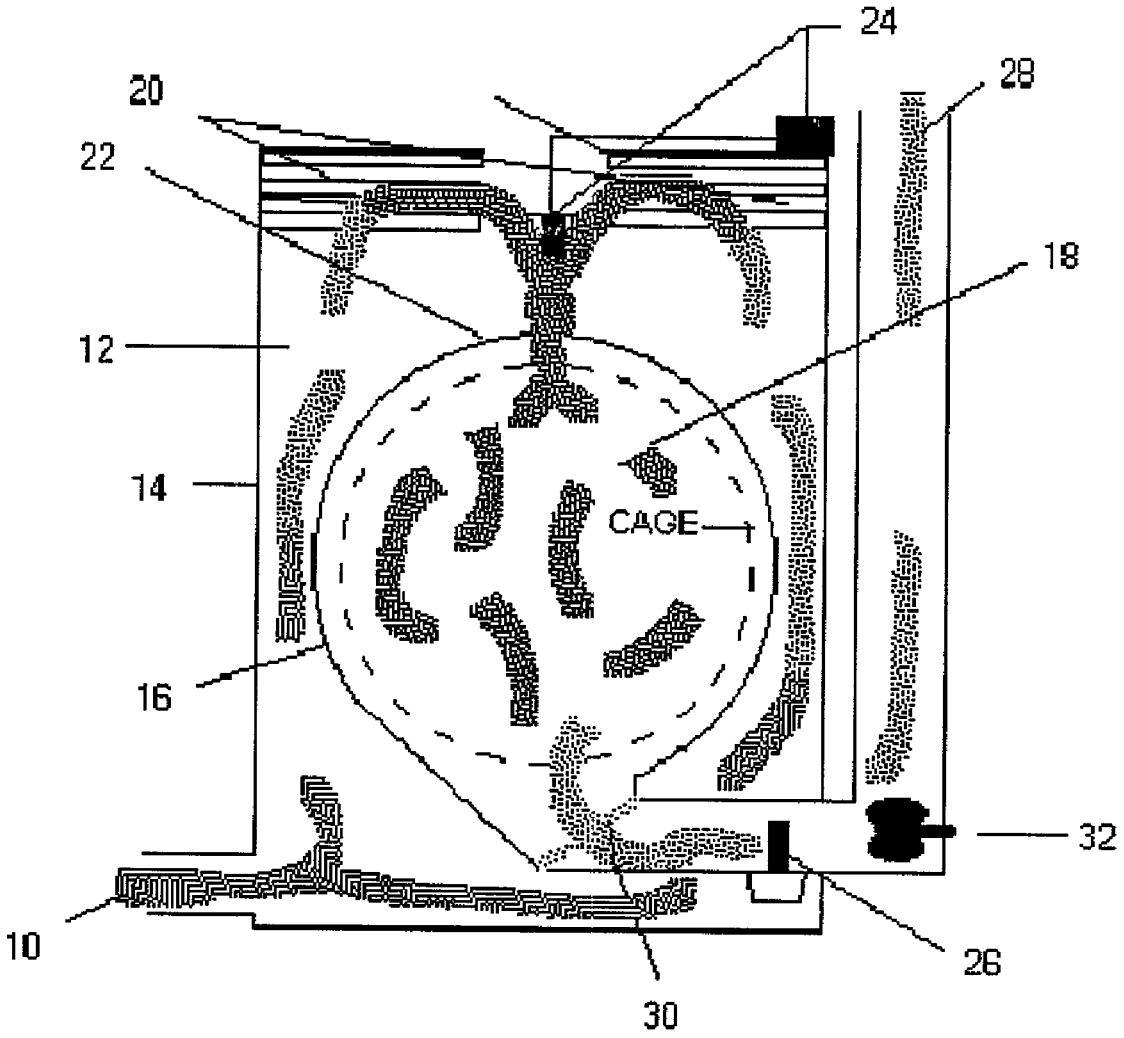
FIG. 3 shows a dryer assembly according to the present invention, including an electrostatic vapor generator and a temperature and/or humidity sensor.

The electrostatic vapor generator may be positioned in any manner within the dryer provided it is capable of dispensing a vapor or mist onto articles of laundry contained within the dryer during the drying process. In one embodiment the electrostatic vapor generated is remotely mounted with respect to the dryer drum within the air inflow area of the dryer. This embodiment is depicted in FIG. 3 which shows a dryer assembly having an air inlet 10 that allows for the introduction of air into an internal cavity 12 defined by the outer case of the dryer 14 and the inner case 16, containing the dryer drum 18. The air within this cavity passes over heaters 20 and then flows into the dryer drum 18 through an air inflow area 22. The electrostatic vapor generator 24 is located between and just below the heaters and above the dryer drum 18. Alternatively, the electrostatic vapor generator may located elsewhere within the internal cavity or between the inner and outer case of the dryer drum itself.

The humidity and/or temperature sensor may be positioned in any manner within the dryer provided it is capable of obtaining an accurate reading of the humidity and temperature within the drum of the dryer where laundry is housed during the drying process. In one embodiment, shown in FIG. 3, a humidity and/or temperature sensor 26 is located in the exhaust duct 28 of the dryer, just beyond the lint screen 30 and before the extract fan 32.

In one embodiment, the apparatus further includes a processing means interfaced with the sensor and/or timing device for automatically controlling the initiation and duration of the dispensation of the fragrance composition by the electrostatic vapor generator. Using such an apparatus, a fragrance composition can be added to laundry in a dryer by electronically monitoring at least one operating parameter in a dryer to determine when it meets a preset condition and electronically triggering the electrostatic vapor generator to dispense a fragrance composition into the dryer once that condition has been met. Briefly, this process would entail measuring the operating parameter using a sensor device, periodically comparing the measurements to the preset condition, and triggering the electrostatic vapor generator once the preset condition matches the actual dryer operating parameter.

The processing means may be a device comprising a comparator that is able to measure at least one operating parameter of the dryer, compare it to a preset condition, and switch on the electrostatic vapor generator once the preset condition has been met. Alternatively, the device may comprise a processor that is programmed to determine when at least one operating parameter has met a preset condition and triggering the electrostatic vapor generator to dispense a fragrance composition once that preset condition has been met. In various embodiments the device is also capable of monitoring a second preset condition and stopping the electrostatic vapor generator from dispensing the fragrance composition once that second preset condition has been met. The operating parameters that may be monitored include the humidity level inside the dryer, the temperature inside the dryer, or the time elapsed since the beginning of the drying process (i.e. since the dryer was turned on). Analogously, the preset conditions may be a given humidity level inside the dryer, a given temperature inside the dryer, or a given length of time with respect to the beginning of the drying process. These conditions may be chosen based on such considerations as the capacity of the dryer and the amount of fragrance desired.

In one embodiment the apparatus is controlled electronically using a controlling device comprising a sensor, a control logic circuit, and two switches. The sensor may be a humidistat/moisture sensor or a thermometer/thermocouple, located in the drum of the dryer or in the air exhaust duct. The control logic circuit may be programmed to open the first switch after a pre-determined set of conditions has been met (i.e. detected by the sensor) and to close the second switch for a preset amount of time. The first switch could be linked to the power controlling the heating element in the dryer and the second switch could be linked to the pump power supply.

Another aspect of the invention provides fragrance compositions capable of being dispersed electrostatically onto laundry in a dryer. The fragrance compositions are substantially non-aqueous, have a viscosity between about 0.1 to about 50 centipoise, and include at least one glycol, at least one vegetable oil, and at least one fragrance. The fragrance makes up a substantial portion of the composition, being present in an amount of at least about 10 weight percent and up to about 80 weight percent. This is in stark contrast to the scented conditioning compositions that are presently used to impart fragrances to laundry. These scented conditioners are typically aqueous mixtures containing only a few weight percent of a fragrance. In one embodiment of the present invention, the fragrance composition is substantially free of fabric softening agents, such as those described above.

The glycols act as a carrier for the fragrance and impart a certain degree of conductivity to the compositions which enables them to be electrostatically dispensed. In addition, glycols act as humectants, helping to maintain laundry moisture levels when the moisture content falls below the ambient moisture content (i.e. when the laundry becomes "over-dried"). Glycols can comprise about 0.1 to about 20 weight percent of the fragrance composition. This includes embodiments wherein the glycols comprise about 1 to about 10 weight percent of the fragrance compositions. In various embodiments glycols will be present in an amount between about 5 and about 15 weight percent. Examples of suitable glycols for use in the present compositions include, but are not limited to glycerol, propylene glycol, dipropylene glycol, triethylene glycol, and combinations thereof.

Vegetable oils may comprise about 0.1 to about 80 weight percent of the fragrance compositions. In various embodiments vegetable oils will be present in an amount between about 5 and about 15 weight percent. The oils act as a carrier for the fragrance compositions and impart a degree of conductivity to the compositions which allows them to be electrostatically dispensed. Examples of suitable vegetable oils for use in the present compositions include, but are not limited to, canola oil, sunflower oil, soybean oil, corn oil, castor oil, olive oil, coconut oil, palm oil, and combinations thereof.

The fragrance is responsible for imparting a fresh smell to the laundry. In addition to imparting favorable aromas to the laundry, the fragrance also acts as a conductivity control component. The fragrance should be present in an amount sufficient to provide the composition with a conductivity between about 0.01 to about 1.0 microsiemens per centimeter. This includes embodiments where the conductivity is between about 0.1 and about 0.2 microsiemens per centimeter. This conductivity level provides an electrostatic delivery rate sufficient for applying a fragrance composition to laundry in a dryer. These conductivity levels correspond to electrostatic delivery rates between about 0.001 and about 0.05 grams per hour. In some embodiments, the electrostatic rate of delivery will be between about 0.01 and about 0.05 grams per hour.

In various embodiments, the fragrance makes up between about 1 to about 95 weight percent of the fragrance compositions. In various embodiments fragrance will be present in an amount between about 30 and about 90 weight percent. This includes embodiments where the fragrance is present in an amount between about 70 and about 90 weight percent. The fragrance, or perfume, may be any fragrant substance or mixture of substances, including natural and synthetic substances, that have a favorable aroma. In addition, the fragrance or perfume may contain auxiliary materials such as fixatives, extenders, stabilizers and solvents. Examples of suitable fragrances include, but are not limited to, silicon oils, essential oils, absolutes, resinoids, resins, and synthetic perfume components such as hydrocarbons, alcohols, aldehydes, ketones, ethers, acids, esters, acetals, ketals, nitrites, including saturated and unsaturated compounds, aliphatic, carbocyclic and heterocyclic compounds. Examples of such perfume components are geraniol, geranyl acetate, linalool, linaly acetate, tetrahydrolinalool, citronellol, citronellyl acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimethylbenzylcarbinol, trichloromethylphenylcarbinyl methylphenylcarbinyl acetate, p-tert-butyl-cyclohexyl acetate, isononyl acetate, vetiveryl acetate, vetiverol, alpha-n-amylcinammic aldehyde, alpha-hexyl-cinammic aldehyde, 2-methyl-3-(p-tert-.butylphenyl)-propanal, 2-methyl-3-(p-isopropyl-phenyl) propanal, 3-(p-tert.butylphenyl)propanal, tricyclodecenyl acetate, tricyclodecenyl propionate, 4-(4-hydroxy-4-methyl-pentyl)-3-cyclohexenecarbaldehyde, 4-(4-methyl-3-pentenyl)-3-cyclohexenecarbaldehyde, 4-acetoxy-3-pentyltetrahydropyran, methyl dihydrojasmonate, 2-n-heptylcyclopentanone, 3-methyl-2-pentyl-cyclopentanone, n-decanal, n-dodecanal, 9-decenol-1, phenoxyethyl isobutyrate, phenylacetaldehyde dimethyl acetal, phenylacetaldehyde diethyl acetal, geranonitrile, citronellonitrile, cedryl acetal, 3-isocam-phylcyclohexanol, cedryl methyl ether, isolongifolanone, aubepine nitrile, aubepine, heliotropine, coumarin, eugenol, vanillin, diphenyl oxide, hydroxycitronellal ionones, methyl ionones, isomethyl ionomes, irones, cis-3-hexenol and esters thereof, indane musk fragrances, tetralin musk fragrances, isochroman musk fragrances, macrocyclic ketones, macrolactone musk fragrances, ethylene brassylate, aromatic nitro-musk fragrances. A specific example of a suitable fragrance is Softy AR 3329, a fragrance manufactured by CPL Aromas UK. Softy AR 3329 contains dipropylene glycol, HHCB (1,3,4,6,7,8-hexahydro-4,6,6,7,8,8-hexamethylcyclopenta-(g)-2-benzopyran), and 1,1,6,7-tetramethyl-6-acetyldecalene, in addition to small quantities of various essential oils, alcohols, esters, hydrocarbons, and aldehydes.

Some fragrances themselves contain glycols and vegetable oils. When these fragrances are used with the present invention it should be understood that the glycols and vegetable oils contained within the fragrance are to be considered part of the glycol and vegetable oil components of the fragrance composition and not part of the fragrance itself. For example, a fragrance composition comprising 0.1 to 20 weight percent glycol comprises a total of 0.1 to 20 weight percent glycol, including any glycol that might be present in the perfume in the composition.

Examples of suitable fragrances, or perfumes, are provided in U.S. Pat. No. 5,234,610, which is herein incorporated by reference.

In one specific embodiment this invention provides a composition comprising approximately 10 weight percent vegetable oil, approximately 10 weight percent of a glycol, and approximately 80 weight percent fragrance. In this embodiment the vegetable oil may be canola oil, and the glycol may be glycerol.

Yet another aspect of the invention provides a method and kit for adding fragrance to laundry without substantial loss of residual fragrance during the drying process. The method is based on the inventor's discovery that post-laundering residual fragrance can be preserved by separating the laundry softening and conditioning steps from the step of adding fragrance to laundry in a dryer. Specifically, residual fragrance can be enhanced by applying laundry conditioning compositions to articles of laundry prior to applying a fragrance composition. In this manner laundry softeners and conditioners can be added to laundry during the wash cycle in a washer, at the start of the drying process in a dryer, or at an early stage of the drying process. The fragrance can be added to the laundry at a later time, such as during the cool-down cycle in a dryer. This method provides several advantages. First, it allows non-volatile softening and conditioning compounds to be added to laundry before the drying process begins, maximizing their time of exposure to the laundry and thereby enhancing their conditioning effects. At the same time, by allowing the fragrance to be added at a later point in the drying cycle, the volatile fragrant components avoid prolonged exposure to high dryer temperatures which cause them to evaporate off before the drying process can be completed. In addition, separating the softening composition from the fragrance composition makes it possible to optimize the components that go into each.

In carrying out this method, the conditioning composition may be added during the wash cycle in a washing machine and the fragrance composition may be added during the drying process in a dryer. Alternatively, the conditioning composition may be added during the drying process in a dryer and the fragrance composition may be added at a later time during the drying process. It should be noted that the conditioning composition may be added over a period of time, and that for the purposes of this invention, the fragrance composition is added after the conditioning composition as long as it is added at any time after the initial addition of the conditioning composition.

In one embodiment, the method is carried out by a computer and software adapted to control the initiation and duration of the dispensation of the fragrance composition. The computer may also be adapted to control the rate and quantity of dispensation.

The invention also provides a kit for carrying out the method described above. This kit comprises a fabric conditioning composition and a separate fragrance composition. The kit may also comprise instructions describing when the conditioning composition and the fragrance composition should be added to the laundry during the washing or drying process. In one embodiment, the conditioning composition in the kit is adapted to be added to laundry in a washer and the fragrance composition is adapted to be added to the same laundry after it has been transferred to a dryer. The fragrance composition may be best suited for addition during the cool-down cycle in the dryer. In another embodiment, the conditioning composition in the kit is adapted to be added to laundry in a dryer in the beginning, or at an early stage, of the drying process while the fragrance composition is adapted to be added during a later stage, for example, during the cool-down cycle. In yet another embodiment, the conditioning composition is adapted to be added over a period of time during the drying process. This embodiment includes conventional methods for applying conditioning compositions to laundry in a dryer, such as those discussed above in the Background of the Invention section. Again, the fragrance composition in the kit is adapted to be added after the initial introduction of the conditioning composition into the dryer.

Suitable conditioning compositions for use with the kit may include conventional conditioning, softening, and anti-static agents well known in the art, in addition to water and other additives, as discussed above. The conditioning composition may itself contain a fragrance or perfume. The conditioning composition may be provided in the form of a liquid or solid or may be contained in a dryer sheet. The conditioning composition may be a adapted to be added to laundry during the wash cycle in a washing machine. Alternatively, the conditioning composition may be adapted to be applied to the laundry through direct contact with laundry in the dryer or may be adapted to be sprayed onto the laundry in a dryer in the form of a vapor, mist, or aerosol.

In various embodiments the conditioning compositions comprise about 1 to about 45 weight percent of a softening agent, optionally about 0.1 to about 5 weight percent of a fragrance, and the remainder water. This includes embodiments where the compositions comprise about 5 to about 25 weight percent of a softening agent, optionally about 0.3 to about 3 weight percent of a fragrance, and the remainder water. This further includes embodiments where the compositions comprise about 10 to about 20 weight percent of a softening agent, optionally about 0.5 to about 2 weight percent of a fragrance, and the remainder water.

The fragrance composition may be a composition that is capable of being dispersed electrostatically, as described above. Alternatively, the fragrance composition may be a more conventional fragrance or perfume. Typically, the fragrance compositions are non-aqueous. Suitable fragrances and perfume components have been described above. In various embodiments the fragrance composition is substantially free of fabric softening agents.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above.

The invention is described in more detail in the following non-limiting examples. These examples demonstrate the improvement in fragrance retention for laundry which is treated with a conditioning composition and a fragrance composition in separate steps. In each example, ten towels were washed in a Professional Unimac 35 Pounder Washing Machine and dried in a Unimac Professional Electrical Laundry Dryer.

EXAMPLES

Example 1

Introduction of Softener in Washing Cycle and Fragrance in Dryer During the Cool-down Cycle In this example, 30 milliliters of a 25% Accosoft 501 laundry softener was added to the towels during the rinse cycle in the washing machine. Accosoft 501 is a tallow diamidoamine type cation sold by Stepan Company of Northfield, Ill. The machine was run for seven minutes at 64° F. followed by a four minute high spin cycle. The towels were then transferred to the dryer which was run at 180° F. for 23 minutes, at which time the cool-down cycle began.

Two grams of a mixture of Softy AR 3329 (45%), benzyl alcohol (7%), and Dymel 152 (48%), an aerosol propellant made by Dow Chemical, was added as an aerosol during the cool-down period, which lasted seven minute and a half minutes.

Example 2

Introduction of Softener and Fragrance in Washing Cycle

In this example, 30 milliliters of Accosoft 25% laundry softener and 2 grams of Softy AR 3329 fragrance were added to the towels during the rinse cycle in the washing machine. The machine was run for seven minutes at 64° F. followed by a four minute high spin cycle. The towels were then transferred to the dryer which was run at 180° F. for 23 minutes, followed by a seven and a half minute cool-down period.

Comparison: The residual fragrance on the towels was evaluated by a panel of ten people who smelled the towels every day for a week following the experiments conducted in Examples 1–3 above. The results from the ten person panel demonstrated that the residual fragrance was strongest for the towels when the softening composition was added during the washing cycle and the fragrance composition was added during the cool-down period in the dryer.

Example 3

Fragrance Strength and Longevity

Forty 100% cotton terry cloth towels were scoured with 200 grams of highly alkaline detergent for ten minutes at 140° F. then subsequently rinsed three consecutive times to remove all traces of softener, detergent, and fragrance. Twenty towels were randomly selected and washed for 5 minutes in 90° F. water on the low setting in a Unimac UF-35, 35 lb. Capacity washing machine followed by a 4 minute high speed extract. Fifty grams of a 15% dispersion of Accosoft 808 was added at the start of the wash. Accosoft 808 is a tallow imadazoline type softener sold by Stepan Company of Northfield, Ill. The towels were placed in a Unimac electric dryer on a 35 minute high temperature drying cycle followed by a 5 minute cool down. Five different variations were run as follows:

Run A. 0.5 grams of Softy AR 3329 was added to the a laundry softener which was added during the wash cycle.

Run B. Ten grams of a 5% solution of Softy AR 3329 in ethanol was sprayed into the dryer 15 minutes after the start of the dryer cycle.

Run C. Ten grams of a 5% solution of Softy AR 3329 in ethanol was sprayed into the dryer 25 minutes after the start of the dryer cycle.

Run D. No fragrance was added.

Run E. Ten grams of a 5% solution of Softy AR 3329 in ethanol was sprayed into the dryer one minute after the start of the cool down cycle.

Five towels from each run were labeled and placed in plastic bags until all of the wash runs had been completed. The order of washing was randomized. The fifteen towels that were not stored from each run were scoured and reused. The fragrance solution was sprayed into the dryer via a peristaltic pump with micro bore tubing (⅛" O.D., 1/16" I.D.) connected to a spray can valve. The valve assembly was attached to the top of the of the dryer door with duct tape. The peristaltic pump was timed to deliver 20 grams of a 2.5% fragrance solution.

After all runs were completed, all of the towels were removed from the plastic bags and allowed to stand out in the open under ambient conditions. A panel test was run at 2 days and twelve days. The panel test was a forced ranking of the residual fragrance on the towels of first through third for various sets of three towels, with "first" indicating the strongest residual fragrance. Twenty two panelists participated in the 2 day test and fifteen panelists participated in the twelve day test. Table 1 below indicates the runs used in each set as well as the results of the panel tests.

TABLE 1

| Set Number | Runs Used in Set | Number of Panelists Ranking Run E First after 2 Days | Number of Panelists Ranking Run E First after 12 Days |
|---|---|---|---|
| 1 | A, B, E | 20/21 | 10/15 |
| 2 | A, D, E | 21/21 | 14/15 |
| 3 | B, C, E | 21/21 | 15/15 |
| 4 | C, D, E | 15/22 | 15/15 |

While preferred embodiments have been illustrated and described, it should be understood that changes and modifications can be made therein in accordance with ordinary skill in the art without departing from the invention in its broader aspects as defined in the following claims.

What is claimed is:

1. An apparatus for adding fragrance to laundry comprising:

(a) a dryer; and (b) an electrostatic vapor generator mounted within the dryer for dispensing a fragrance composition into the dryer.

2. The apparatus of claim 1 further comprising at least one of a temperature sensor or a humidity sensor mounted within the dryer for triggering the electrostatic vapor generator to dispense a fragrance composition into the dryer.

3. The apparatus of claim 1 further comprising a timing device capable of triggering the electrostatic vapor generator to dispense a fragrance composition into the dryer.

4. A method for delivering a fragrance composition to laundry comprising the steps of:

(a) electronically monitoring at least one operating parameter of a clothes dryer to determine when the parameter meets a first preset condition; and (b) electronically triggering an electrostatic vapor generator to dispense a fragrance composition into the clothes dryer once the first preset condition has been met.

5. The method of claim 4 wherein the operating parameter is selected from the group consisting of the temperature inside the dryer, the humidity level inside the dryer, and the time elapsed since the beginning of the drying cycle.

6. The method of claim 5, further comprising:

(a) electronically monitoring at least one operating parameter of a clothes dryer to determine when the parameter meets a second preset condition; and (b) electronically stopping the electrostatic vapor generator from dispensing a fragrance composition into the clothes dryer once the second preset condition has been met.

7. The method of claim 4 wherein the fragrance composition comprises a glycol, a vegetable oil, and a fragrance.

8. A system for delivering a fragrance composition to laundry comprising:

(a) a dryer;

(b) an electrostatic vapor generator mounted within the dryer;

(c) a sensor mounted within the dryer, the sensor capable of measuring at least one operating parameter of the dryer;

(d) and a processor interfaced with the sensor, the processor programmed to:

(i) determine when the operating parameter measured by the sensor meets a first preset condition;

(ii) trigger the electrostatic vapor generator to dispense a fragrance composition into the clothes dryer once the preset condition has been met.

9. The system of claim 8 wherein the operating parameter is selected from the group consisting of the temperature inside the dryer, the humidity level inside the dryer, and the time elapsed since the beginning of the drying cycle.

10. The system of claim 8 wherein the processor is further programmed to:

(a) determine when the operating parameter measured by the sensor meets a second preset condition; and (b) stop the electrostatic vapor generator from dispensing a fragrance composition into the clothes dryer once the second preset condition is met.

11. The system of claim 8 further comprising a reservoir integrated with the electronic vapor generator, the reservoir containing a fragrance composition comprising a glycol, a vegetable oil, and a fragrance.

12. A system for delivering a fragrance composition to laundry comprising:

(a) a dryer;

(b) an electrostatic vapor generator mounted within the dryer;

(c) a sensor mounted within the dryer, the sensor capable of measuring at least one operating parameter of the dryer;

(d) a processing means interfaced with the sensor for:

(i) reading the operating parameter measurements from the sensor;

(ii) comparing the operating parameter measurements to a first preset condition; and (iii) triggering the electrostatic vapor generator to dispense a fragrance composition into the clothes dryer once the operating parameter matches the preset condition.

13. The system of claim 12 wherein the operating parameter is selected from the group consisting of the temperature inside the dryer, the humidity level inside the dryer, and the time elapsed since the beginning of the drying cycle.

14. The system of claim 12 wherein the processing means is further capable of:

(a) comparing the operating parameter measurements to a second preset condition; and (b) stopping the electrostatic vapor generator from dispensing a fragrance composition into the clothes dryer once the operating parameter matches the second preset condition.

15. The system of claim 12 further comprising a reservoir integrated with the electronic vapor generator, the reservoir containing a fragrance composition comprising a glycol, a vegetable oil, and a fragrance.

16. The apparatus of claim 1 further comprising a reservoir integrated with the electrostatic vapor generator, the reservoir containing a fragrance composition comprising about 10 to 80 wt. % fragrance.

17. The apparatus of claim 1 further comprising a reservoir integrated with the electrostatic vapor generator, the reservoir containing a fragrance composition comprising about 30 to 90 wt. % fragrance.

18. The apparatus of claim 1 further comprising a reservoir integrated with the electrostatic vapor generator, the reservoir containing a fragrance composition having a conductivity of about 0.01 to 1.0 micro siemens per cm.

19. The apparatus of claim 1 further comprising a reservoir integrated with the electrostatic vapor generator, the reservoir containing a fragrance composition having a conductivity of about 0.1 to 0.2 microsiemens per cm.

20. The method of claim 4 wherein the fragrance composition comprises about 10 to 80 wt. % fragrance.

21. The method of claim 1 wherein the fragrance composition comprises about 30 to 90 wt. % fragrance.

22. The method of claim 4 wherein the fragrance composition has a conductivity of 0.01 to 1.0 microsiemens per cm.

23. The method of claim 1 wherein the fragrance composition has a conductivity of 0.1 to 0.2 microsiemens per cm.

24. The method of claim 1 wherein the fragrance composition is dispensed at a delivery rate of about 0.00 1 to 0.05 grams per hour.

25. The method of claim 4 wherein the electrostatic vapor generator is electronically triggered during a cool-down cycle of the clothes dryer.

26. The system of claim 8 further comprising a reservoir integrated with the electrostatic vapor generator, the reservoir containing a fragrance composition comprising about 10 to 80 wt. % fragrance.

27. The system of claim 8 further comprising a reservoir integrated with the electrostatic vapor generator, the reservoir containing a fragrance composition comprising about 30 to 90 wt. % fragrance.

28. The system of claim 8 further comprising a reservoir integrated with the electrostatic vapor generator, the reservoir containing a fragrance composition having a conductivity of about 0.01 to 1.0 microsiemens per cm.

29. The system of claim 8 further comprising a reservoir integrated with the electrostatic vapor generator, the reservoir containing a fragrance composition having a conductivity of about 0.1 to 0.2 microsiemens per cm.

30. The system of claim 8 wherein the processor is programmed to trigger the electrostatic vapor generator to dispense the fragrance composition during a cool-down cycle of the dryer.

31. The system of claim 8 wherein the fragrance composition is dispensed at a rate of about 0.001 to 0.05 grams per hour.

32. The system of claim 12 further comprising a reservoir integrated with the electrostatic vapor generator, the reservoir containing a fragrance composition comprising about 10 to 80 wt. % fragrance.

33. The system of claim 12 further comprising a reservoir integrated with the electrostatic vapor generator, the reservoir containing a fragrance composition comprising about 30 to 90 wt. % fragrance.

34. The system of claim 12 further comprising a reservoir integrated with the electrostatic vapor generator, the reservoir containing a fragrance composition having a conductivity of about 0.01 to 1.0 microsiemens per cm.

35. The system of claim 12 further comprising a reservoir integrated with the electrostatic vapor generator, the reservoir containing a fragrance composition having a conductivity of about 0.1 to 0.2 microsiemens per cm.

* * * * *